US009759426B2

(12) United States Patent
Johnson et al.

(10) Patent No.: US 9,759,426 B2
(45) Date of Patent: Sep. 12, 2017

(54) COMBUSTOR NOZZLES IN GAS TURBINE ENGINES

(71) Applicant: General Electric Company, Schenectady, NY (US)

(72) Inventors: Thomas Edward Johnson, Greer, SC (US); Christopher Paul Keener, Denver, NC (US); Jason Thurman Stewart, Greer, SC (US); Heath Michael Ostebee, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 375 days.

(21) Appl. No.: 14/448,321

(22) Filed: Jul. 31, 2014

(65) Prior Publication Data

US 2016/0033133 A1 Feb. 4, 2016

(51) Int. Cl.
*F23R 3/28* (2006.01)
*F23R 3/10* (2006.01)

(52) U.S. Cl.
CPC ..... *F23R 3/286* (2013.01); *F23R 3/10* (2013.01)

(58) Field of Classification Search
CPC .. F23R 3/283; F23R 3/286; F23R 3/10; F23R 3/46; F23D 14/62; F23D 14/64; F02C 7/222; F02M 61/14
See application file for complete search history.

(56) References Cited

U.S. PATENT DOCUMENTS

| | | | | |
|---|---|---|---|---|
| 4,100,733 | A * | 7/1978 | Striebel | F23R 3/286 239/419.3 |
| 4,719,748 | A * | 1/1988 | Davis, Jr. | F01D 5/187 60/39.37 |
| 7,469,544 | B2 | 12/2008 | Farhangi | |
| 9,033,699 | B2 * | 5/2015 | Stoia | F23R 3/286 431/144 |
| 2011/0083439 | A1 * | 4/2011 | Zuo | F23D 14/64 60/737 |
| 2012/0023951 | A1 * | 2/2012 | Parsania | F23C 7/004 60/748 |
| 2012/0060511 | A1 * | 3/2012 | Zuo | F01D 25/12 60/806 |
| 2013/0036743 | A1 | 2/2013 | Khan et al. | |
| 2013/0122438 | A1 * | 5/2013 | Stoia | F23R 3/286 431/144 |

* cited by examiner

*Primary Examiner* — Pascal M Bui Pho
*Assistant Examiner* — Stefan Ibroni
(74) *Attorney, Agent, or Firm* — Mark E. Henderson; Ernest G. Cusick; Frank A. Landgraff

(57) ABSTRACT

A micro-mixer nozzle for use in a combustor of a combustion turbine engine, the micro-mixer nozzle including: a fuel plenum defined by a shroud wall connecting a periphery of a forward tube sheet to a periphery of an aft tubesheet; a plurality of mixing tubes extending across the fuel plenum for mixing a supply of compressed air and fuel, each of the mixing tubes forming a passageway between an inlet formed through the forward tubesheet and an outlet formed through the aft tubesheet; and a wall mixing tube formed in the shroud wall.

19 Claims, 6 Drawing Sheets

COMBUSTOR NOZZLES IN GAS TURBINE ENGINES

FEDERAL RESEARCH STATEMENT

This invention was made with Government support under Contract No. DE-FC26-05NT42643, awarded by the Department of Energy. The Government has certain rights in the invention.

BACKGROUND OF THE INVENTION

The present invention relates to combustion systems in gas turbine engines, and more particularly, to apparatus and systems related to the configuration and design of combustor nozzles and fuel injectors.

Combustion turbine engines or "gas turbines" are widely used in industrial and power generating applications. As will be appreciated, typical gas turbines includes an axial compressor positioned at forward end, a turbine positioned at an aft end, and one or more combustors about the middle portion of the engine. In operation, ambient air enters the compressor, and rotating blades and stationary vanes in the compressor progressively impart kinetic energy so to produce a supply of compressed air. From the compressor, the compressed air is directed into the combustor where it is mixed with a supply of fuel. The air/fuel mixture is then ignited and combusted within the combustor, and the resulting highly energized flow or "working fluid" is then expanded through the rotating blades of the turbine so work may be extracted therefrom. For example, the rotation induced by the flow through the turbine may rotate a shaft that connects to a generator so to produce electricity.

Certain types of combustor nozzles—commonly referred to as "micro-mixer nozzles"—include an array of mixing tubes about which a fuel plenum is formed. The supply of compressed air from the compressor is brought to a forward wall of the fuel plenum and the created pressure boundary drives the air through the tubes toward a combustion zone. The mixing tubes include fuel ports that fluidly communicate with the interior of the fuel plenum, and via these ports fuel is injected into the air moving through the tubes. Brought together in this manner, the fuel and air are suitably mixed before being expelled into the combustion zone for combustion.

Significant temperature differentials develop across different areas within the nozzle during operation. This is problematic because of the uneven thermal expansion that results and the stresses the uneven expansions causes. The temperature differentials develop for several reasons. First, as will be appreciated, the supply of air and fuel typically arrive at the nozzle at significantly different temperatures. Each flow also has different heat transfer characteristics due to the different properties and flow speed of each fluid. Second, the areas immediately surrounding the nozzle operate at different temperatures. For example, because the forward wall of the nozzle is positioned within the cap assembly, it is adjacent to a region having a much lower temperature than the aft portion of the nozzle, which borders the combustion zone. As a result, a significant consideration in designing micro-mixer nozzles relates to alleviating the temperature differentials that typically develop within the nozzle during operation. To the extend this can be achieved, the resulting stresses can be reduced and part life extended.

With conventional nozzle design, mixing tubes that pass through the interior of the fuel plenum usually reside at significantly lower temperatures than the outer walls that define the plenum. This is due to the lower temperature and heat transfer properties of the fuel. The outer walls are exposed to the higher temperatures that surround the plenum and, unlike the mixing tubes, do not have a fuel-air mixture flowing through a passageway defined through it. This results in the outer walls thermally expanding more than the mixing tubes and the development of high strain levels. It also will be appreciated that the conventional wall arrangement results in steep temperature gradients through the thickness of the wall. These conditions cause durability issues, lead to cracking and deformation, and reduce part life.

As will be appreciated, micro-mixer nozzle configurations results in a pressure drop across the nozzle, which is what drives the air through the mixing tubes at such high velocities. Such pressure losses, however, are parasitic and negatively impact overall system efficiency. A further objective of nozzle design is to minimize such losses while still achieving the benefits associated with these types of fuel injection systems. The pressure drop and the flow area through the nozzle defines the mass flow rate through the combustor. Another design constraint is the need to keep the diameter of the combustor head end small, which is due to cooling and packaging requirements. The combination of keeping the head end relatively small while still satisfying high mass flow rates makes the objective of maximizing flow area through the nozzle a significant one. The importance of this is further underscored by the fact that decreasing the cross-sectional area of the mixing tubes enhances the fuel-air mixing they provide. Thus, for a number of reasons, maximizing the area within the nozzle that can be dedicated toward mixing tube placement is important. It will be appreciated that to the extent these competing design objectives may be balanced more effectively, while still promoting performance, durability and cost-effectives, such improvements would be commercially demanded.

BRIEF DESCRIPTION OF THE INVENTION

The present application thus describes a micro-mixer nozzle for use in a combustor of a combustion turbine engine, the micro-mixer nozzle including: a fuel plenum defined by a shroud wall connecting a periphery of a forward tube sheet to a periphery of an aft tubesheet; a plurality of mixing tubes extending across the fuel plenum for mixing a supply of compressed air and fuel, each of the mixing tubes forming a passageway between an inlet formed through the forward tubesheet and an outlet formed through the aft tubesheet; and a wall mixing tube formed in the shroud wall.

These and other features of the present application will become apparent upon review of the following detailed description of the preferred embodiments when taken in conjunction with the drawings and the appended claims.

BRIEF DESCRIPTION OF THE DRAWINGS

These and other features of this invention will be more completely understood and appreciated by careful study of the following more detailed description of exemplary embodiments of the invention taken in conjunction with the accompanying drawings, in which.

DETAILED DESCRIPTION OF THE INVENTION

Figure 1:
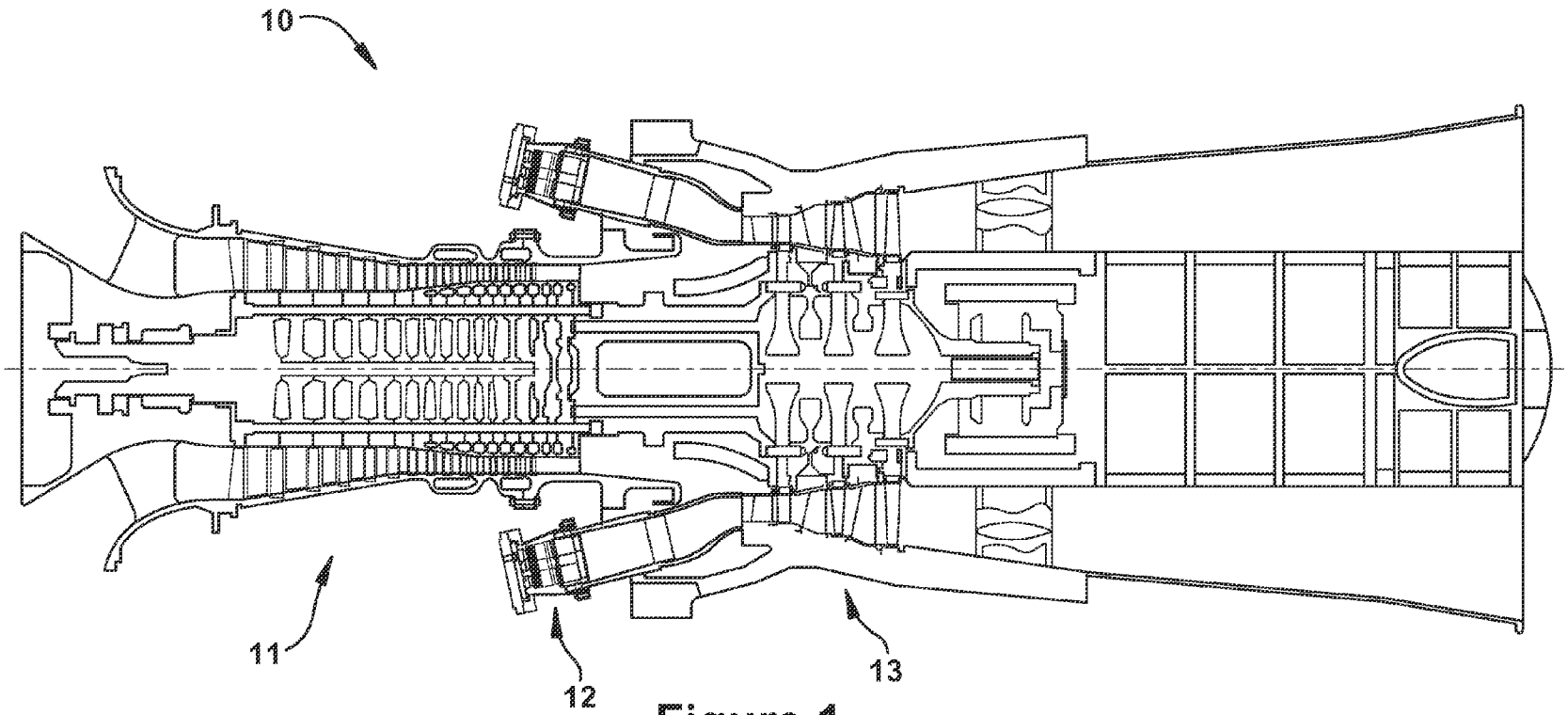
Figure 1 (Prior Art)
FIG. 1 is a section view of a gas turbine engine in which embodiments of the present invention may be used.

In the following text, certain terms have been selected to describe the present invention. To the extent possible, these terms have been chosen based on the terminology common to the field. Still, it will be appreciate that such terms often are subject to differing interpretations. For example, what may be referred to herein as a single component, may be referenced elsewhere as consisting of multiple components, or, what may be referenced herein as including multiple components, may be referred to elsewhere as being a single component. In understanding the scope of the present invention, attention should not only be paid to the particular terminology used, but also to the accompanying description and context, as well as the structure, configuration, function, and/or usage of the component being referenced and described, including the manner in which the term relates to the several figures, as well as, of course, the precise usage of the terminology in the appended claims.

Because several descriptive terms are regularly used in describing the components and systems within turbine engines, it should prove beneficial to define these terms at the onset of this section. Accordingly, these terms and their definitions, unless specifically stated otherwise, are as follows. The terms "forward" and "aft", without further specificity, refer to directions relative to the orientation of the gas turbine. That is, "forward" refers to the forward or compressor end of the engine, and "aft" refers to the aft or turbine end of the engine. It will be appreciated that each of these terms may be used to indicate movement or relative position within the engine. The terms "downstream" and "upstream" are used to indicate position within a specified conduit relative to the general direction of flow moving through it. (It will be appreciated that these terms reference a direction relative to an expected flow during normal operation, which should be plainly apparent to anyone of ordinary skill in the art.) The term "downstream" refers to the direction in which the fluid is flowing through the specified conduit, while "upstream" refers to the direction opposite that.

Thus, for example, the primary flow of working fluid through a turbine engine, which consists of air through the compressor and then becoming combustion gases within the combustor and beyond, may be described as beginning at an upstream location at an upstream end of the compressor and terminating at an downstream location at a downstream end of the turbine. In regard to describing the direction of flow within a common type of combustor, as discussed in more detail below, it will be appreciated that compressor discharge air typically enters the combustor through impingement ports that are concentrated toward the aft end of the combustor (relative to the combustors longitudinal axis and the aforementioned compressor/turbine positioning defining forward/aft distinctions). Once in the combustor, the compressed air is guided by a flow annulus formed about an interior chamber toward the forward end of the combustor, where the air flow enters the interior chamber and, reversing it direction of flow, travels toward the aft end of the combustor. Coolant flows through cooling passages may be treated in the same manner.

Given the configuration of compressor and turbine about a central common axis as well as the cylindrical configuration common to many combustor types, terms describing position relative to an axis will be used. In this regard, it will be appreciated that the term "radial" refers to movement or position perpendicular to an axis. Related to this, it may be required to describe relative distance from the central axis. In this case, if a first component resides closer to the central axis than a second component, it will be described as being either "radially inward" or "inboard" of the second component. If, on the other hand, the first component resides further from the central axis than the second component, it will be described herein as being either "radially outward" or "outboard" of the second component. Additionally, it will be appreciated that the term "axial" refers to movement or position parallel to an axis. Finally, the term "circumferential" refers to movement or position around an axis. As mentioned, while these terms may be applied in relation to the common central axis that extends through the compressor and turbine sections of the engine, these terms also may be used in relation to other components or sub-systems of the engine. For example, in the case of a cylindrically shaped combustor, which is common to many machines, the axis which gives these terms relative meaning is the longitudinal central axis that extends through the center of the cross-sectional shape, which is initially cylindrical, but transitions to a more annular profile as it nears the turbine.

The following description provides examples of both conventional technology and the present invention, as well as, in the case of the present invention, several exemplary implementations and explanatory embodiments. However, it will be appreciated that the following examples are not intended to be exhaustive as to all possible applications the invention. Further, while the following examples are presented in relation to a certain type of turbine engine, the technology of the present invention also may be applicable to other types of turbine engines as would the understood by a person of ordinary skill in the relevant technological arts.

FIG. 1 is a cross-sectional view of a known gas turbine engine 10 in which embodiments of the present invention may be used. As shown, the gas turbine engine 10 generally includes a compressor 11, one or more combustors 12, and a turbine 13. It will be appreciated that a flowpath is defined through the gas turbine 10. During normal operation, air may enter the gas turbine 10 through an intake section, and then fed to the compressor 11. The multiple, axially-stacked stages of rotating blades within the compressor 11 compress the air flow so that a supply of compressed air is produced. The compressed air then enters the combustor 12 and directed through a nozzle, within which it is mixed with a supply of fuel so to form an air-fuel mixture. The air-fuel mixture is combusted within a combustion zone portion of the combustor so that a high-energy flow of hot gases is created. This energetic flow of hot gases then becomes the working fluid that is expanded through the turbine 13, which extracts energy from it.

Figure 2:
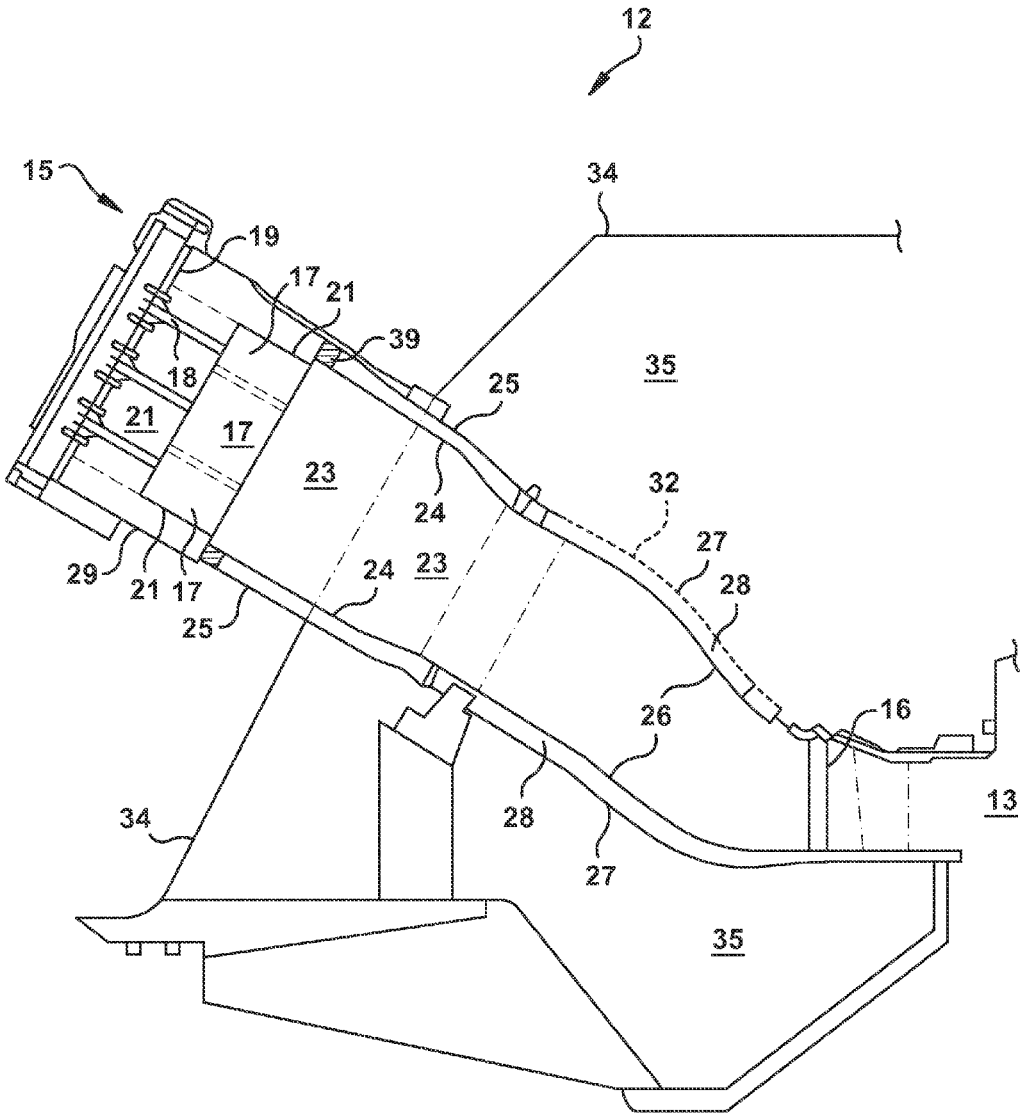
FIG. 2 is a simplified cross-section of a combustor in which embodiments of the present invention may be used.
Figure 3:
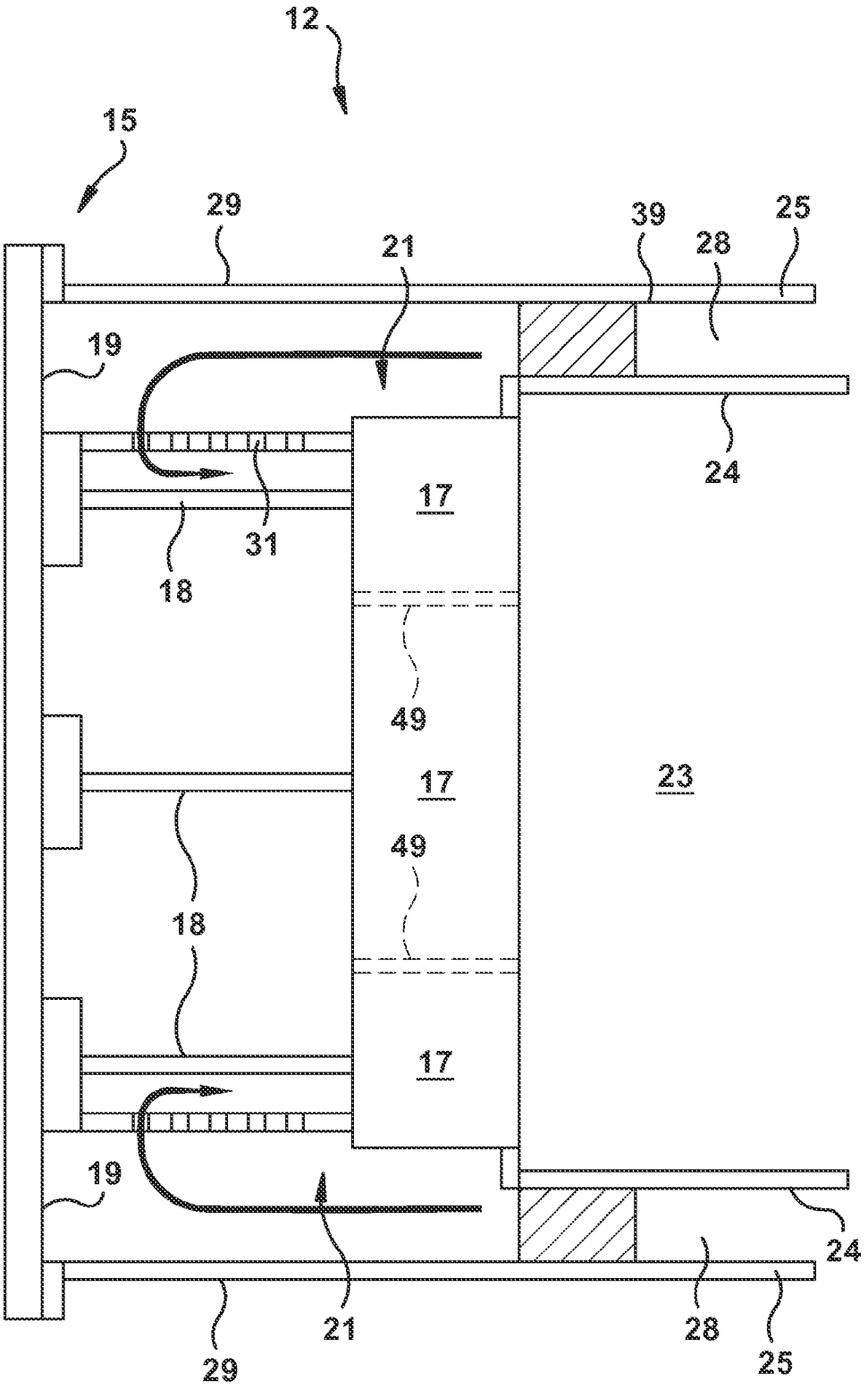
FIG. 3 is an enlarged sectional view of the head end of a combustor in which embodiments of the present invention may be used.

FIG. 2 is a simplified cross-section of a combustor 12 in which embodiments of the present invention may be used, while FIG. 3 provides an enlarged sectional view of the forward portion of the combustor 12. As one of ordinary skill in the art will appreciate, the combustor 12 is axially defined by a forward end, which typically is referred to as a head end 15, and an aft end, which, as illustrated, may be defined by an aft frame 16 that connects the combustor to the turbine. A nozzle 17 may be positioned toward the forward end of the combustor 12. It will be appreciated that the nozzle 17 is the primary component that brings together and mixes the fuel and air that is combusted within the combustor 12. As discussed in more detail below, the nozzle 17 may be configured as a micro-mixer nozzle. As illustrated, the head end 15 generally provides various manifolds, apparatus, and/or fuel lines 18 that provide the fuel to the nozzle 17. The head end 15 also may include an end cover 19 that forms the forward axial boundary of the large interior cavity that is defined in most combustors 12.

The interior cavity of the combustor 12, as illustrated, is divided into several chambers that are configured to direct the working fluid of the engine along a desired flow path. These include a first chamber that is typically defined by a component referred to herein as cap assembly 21. The other chamber includes the combustion zone and is typically defined by a liner and/or transition piece, as discussed below. It will be appreciated that, given this arrangement, these chambers may be described as being axially stacked in their configuration.

The cap assembly 21, as shown, may extend aftward from a connection it makes with the end cover 19, and be surrounded by a combustor casing 29, which is formed outboard of and in spaced relation to it. In this manner, the cap assembly 21 and the combustor casing 29 thereby form an annulus shaped flowpath between them. As discussed below, this annular flowpath—referred to herein as "flow annulus 28"—continues in an aft direction. The cap assembly 29 may house and structurally support the nozzle 17, which may be positioned at or near the aft end of the cap assembly 21. Given this configuration, the cap assembly 21 may be described as including a two smaller chambers or sections that are axially stacked within it, with the first being the forward region that, as indicated by arrows in FIG. 3, accepts a flow of compressed air from the flow annulus 28. The second section within the cap assembly 28 is the region in which the nozzle 17 is defined.

The combustion zone 23 defined just aft of the nozzle 17 is circumferentially defined by a liner 24. The combustion zone 23 is the region where the fuel-air mixture brought together in the nozzle 17 is combusted. From the liner 24, this other chamber may extend through a transition section toward the connection the combustor 12 makes with the turbine 13. Though other configurations are also possible, within this transition section, the cross-sectional area of the second chamber transitions from the circular shape of the liner 24 to a more annular shape that is necessary for directing the flow of combustion products onto the rotor blades of the turbine 13 in a desirable way.

Positioned about the liner 24 is a flow sleeve 25. The liner 24 and flow sleeve 25 may be cylindrical in shape and arranged concentrically. In this manner, the flow annulus 28 formed between the cap assembly 21 and the combustor casing 29 may connect to a continuation of the flow annulus that extends toward the aft end of the combustor 12. Similarly, as illustrated, an impingement sleeve 27 may surround the transition piece 26 so that the flow annulus 28 continues. According to the example provided, the flow annulus 28 loss may extend from approximately the end cover 19 of the head end 15 to the aft end of the combustor 12. More specifically, it will be appreciated that the cap assembly 21/combustor casing 29, the liner 24/flow sleeve 25, and the transition piece 26/impingement sleeve 27 pairings extend the flow annulus 28 a significant portion of the axial length of the combustor 12. The concentrically arranged cylindrical walls that form the flow annulus 28 also may be referred to herein as inner and outer radial walls.

The flow sleeve 25 and/or the impingement sleeve 27 may include a plurality of impingement ports 32 that allow a flow of compressed air external to the combustor 12 into the flow annulus 28. It will be appreciated that, as shown in FIG. 2, a compressor discharge casing 34 may be define a compressor discharge cavity 35 about an aft section of the combustor 12. According to conventional design, the compressor discharge cavity 35 may be configured to receive a supply of compressed air from the compressor 11 and the air may then enter the flow annulus 28 through the impingement ports 32. The impingement ports 32 may be configured to impinge the flow of air entering the combustor 12 against the liner 24 and/or transition piece 26 so to convectively cool those components. Once in the flow annulus 28, the compressed air is directed toward the forward end of the combustor 12, where, via the inlets 31, the flow enters the forward cavity of the cap assembly 21. Within the cap assembly 21, the compressed air is directed to the nozzle 17 where, as mentioned, it is mixed with fuel.

Figure 4:
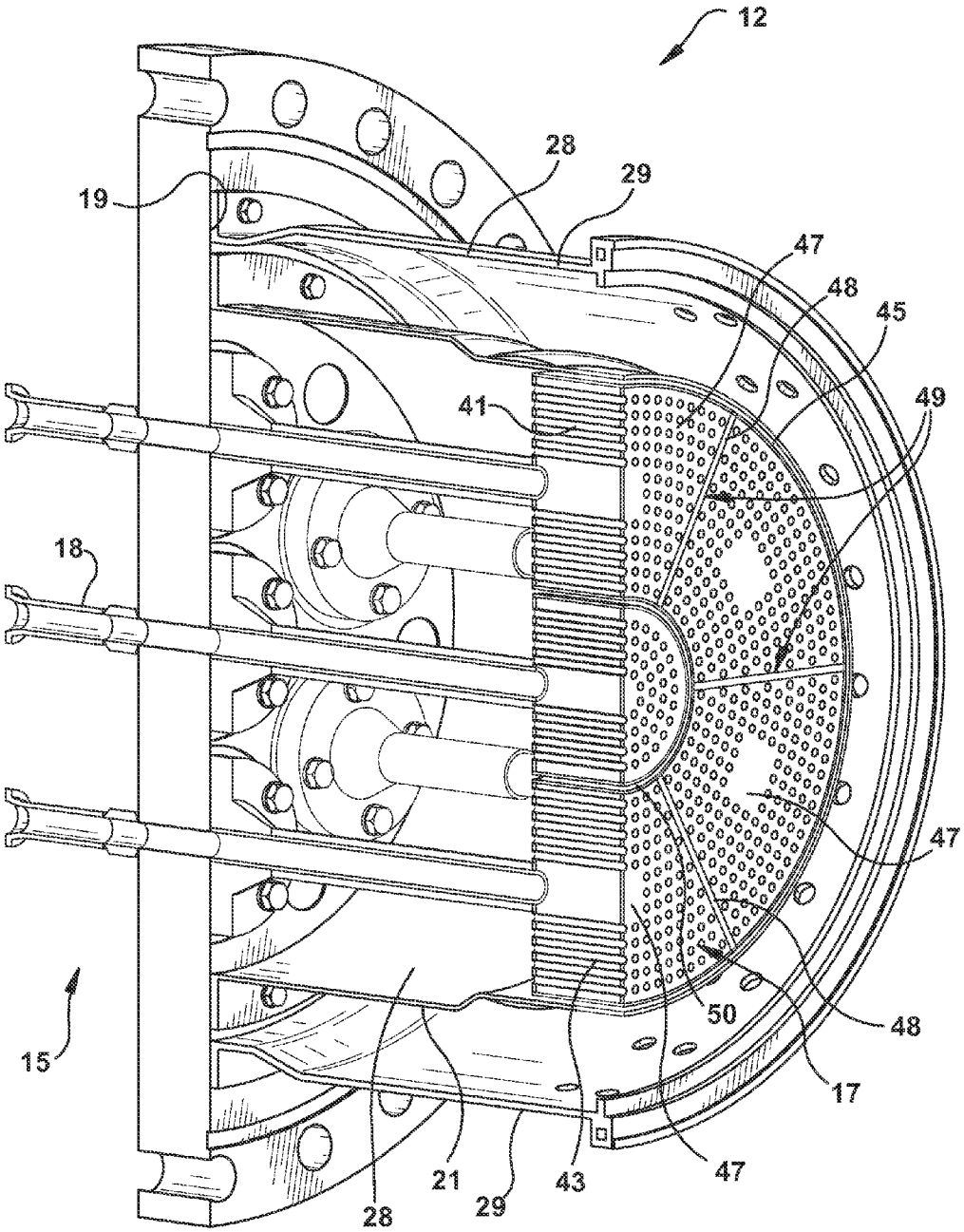
FIG. 4 is a sectional perspective view a cap assembly and nozzle configuration in accordance with aspects of the present invention.
Figure 5:
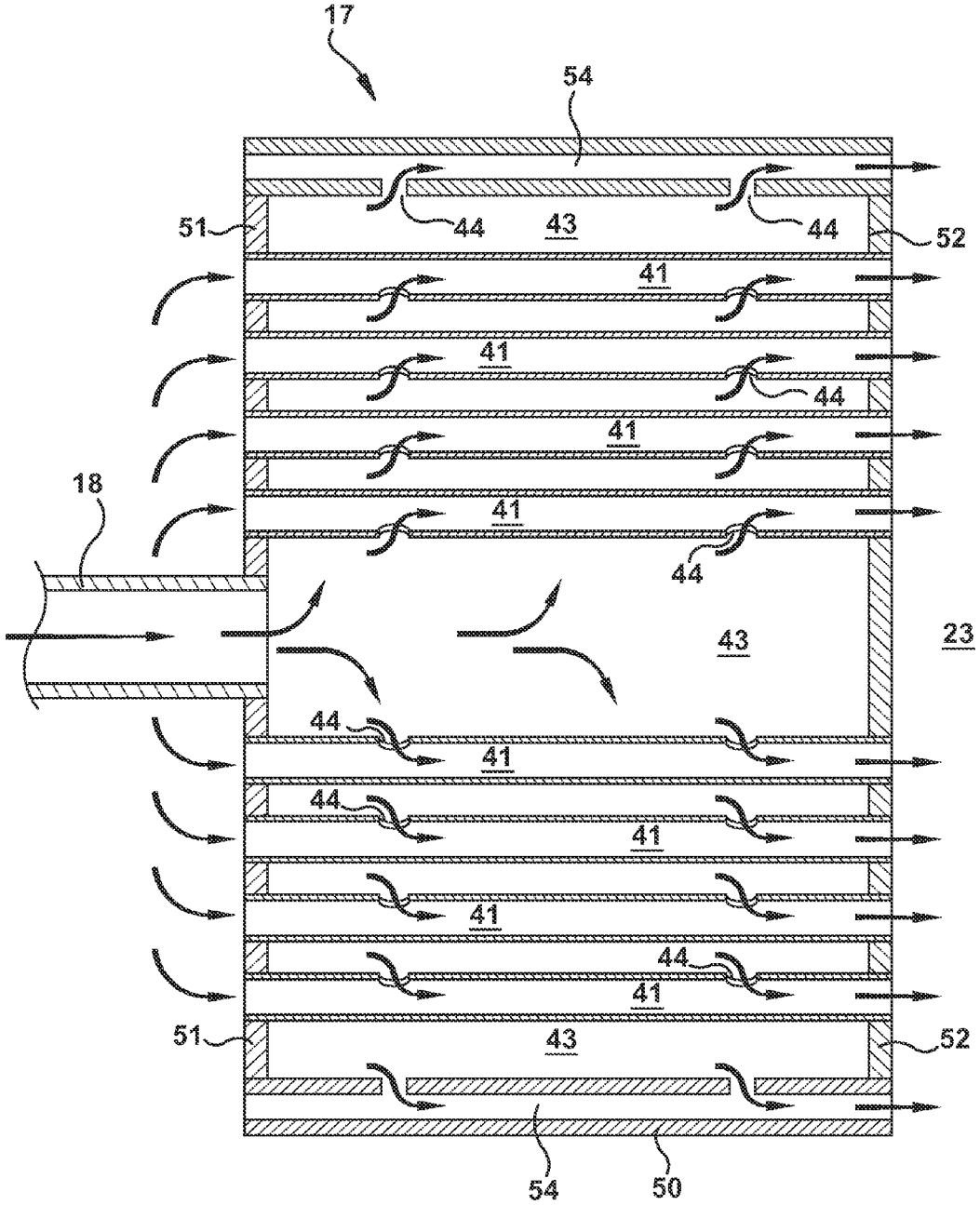
FIG. 5 is a side sectional view of a nozzle in accordance with exemplary embodiments of the present invention.

FIG. 4 is a sectional perspective view a combustor head end 15 having a cap assembly 21 and nozzle 17 configuration according to aspects of the present invention. With reference also to FIG. 5, which provides a sectional view of a nozzle 17 according to the present invention, the fuel nozzle 17 may include a shroud wall 45 that circumferentially surrounds and defines a fuel plenum 43. The fuel plenum 43 may be cylindrical in shape, though other shapes are also possible. The planar ends of the cylindrically shaped fuel plenum 43 are defined by a forward tubesheet 51 and an aft tubesheet 52. It will be appreciated that the fuel plenum 43 may be connected to a supply of fuel by a fuel line 18 that extends through the end cap 18.

The nozzle 17 may include a number of mixing tubes 41 that are arranged in a parallel configuration. The mixing tubes 41 may extend across the axial thickness of the nozzle 17. As will be appreciated, with the fuel plenum 43 defined about the mixing tubes 41, a fuel, such as natural gas, may be injected into the mixing tubes 41 through fuel ports 44 defined therethrough. As shown in FIG. 4, the nozzle 17 may be sectioned into radial sections, which will be referred to as "nozzle sections 47". Given the circular cross-sectional shape of the nozzle 17, the nozzle sections 47 may be wedge shaped in a preferred embodiment. Other configurations are also possible. The nozzle sections 47 are defined by sidewalls 48. The sidewalls 48 of neighboring or adjacent nozzle sections 47, as illustrated, may abut against each other so to form a seam or gap 49 therebetween. This gap 49 extends from an inner radial position that defines the inboard boundary of the nozzle suction 47 to the shroud wall 45, which, as described, defines the outboard boundary of the nozzle suction 47.

The mixing tubes 41 may be configured to extend through the fuel plenum 43 between the forward tubesheet 51 and aft tubesheet 52. More specifically, the mixing tubes 41, as illustrated, may be configured to form a passageway that connects an inlet formed through the forward tubesheet 51 to an outlet formed through the aft tubesheet 52. It will be appreciated that, given this configuration, the inlet provides the means by which the compressed air within the cap assembly 21 enters the nozzle 17. As mentioned, the mixing tube 41 may include one or more fuel ports 44. The fuel ports 44 may be axially spaced along the length of the mixing tube 41, and connect the interior passageway of the mixing tube 41 to the fuel plenum 43. Thus arranged, compressed air fed into the mixing tubes 41 through the inlets on the forward tubesheet 51 is brought together with fuel injected into to the mixing tubes 41 through the fuel ports 44. Within the mixing tubes 41, the fuel and air is mixed and the mixture flows toward the outlet formed through the aft tubesheet 52. In this manner, the outlets deliver an air/fuel mixture to the combustion chamber 23 where it then is combusted. Typically many separate mixing tubes 41 are positioned within the fuel nozzle 17. Further, each of the nozzle sections 47 includes many mixing tubes 41. The mixing tubes 41 may be aligned radially outward of an axial centerline 48 of the nozzle 12, and be configured to extend in a parallel configuration across the axial thickness of the fuel plenum 43.

It will be appreciated that the mixing tubes 41 may have a cross-section that is circular, oval, square, triangular, or any known geometric shape. In a preferred embodiment, as shown, the mixing tubes 41 have a round cross-sectional shape. The inlet and outlet of the mixing tube 41 may simply comprise openings formed through the forward and aft tubesheets 51, 52. The opening may be configured to correspond in a desired way with the size and shape of the interior passageway defined within the mixing tube 41. The upstream and downstream ends of the mixing tubes 41 may be formed to permit air to freely flow through the mixing tubes 41 and mix with fuel injected into the mixing tubes 41 via the fuel ports 44. The fuel ports 44 may simply comprise small openings or apertures in the wall of the mixing tube 41 that allow the fuel to flow from the fuel plenum 43 into the mixing tube 41 in a desired manner. The fuel ports 44 may be axially and circumferentially spaced so to encourage a more uniform mixing of fuel with the air supply moving through the mixing tubes 41. It will be appreciated that the fuel ports 44 may be angled with respect to the axial centerline of the mixing tube 41 to vary the angle at which the fuel enters the mixing tube 41, thus varying the distance that the fuel penetrates into the mixing tube 41 before mixing with the supply of air. In this manner a more uniform mixture of fuel and air may be achieved.

In accordance with exemplary embodiments of the present invention, as illustrated in FIG. 4 through 8, tubes for mixing fuel and air may further be incorporated into the outer walls that define the fuel plenum 43. Such mixing tubes will be referred to herein as "wall mixing tubes 54". It will be appreciated that this configuration may be used to reduce the temperature differential that typically forms in such nozzles of conventional design. Specifically, the temperature differential between the mixing tubes 41 and the outer walls may be reduced by including within the walls wall mixing tubes 54. The inclusion of the wall mixing tubes 54 increases the surface area of the outer wall exposed to the lower temperature fuel moving through the nozzle 17 and thereby reduce the overall temperature of the component during operation. The wall mixing tubes 54 further should reduced what was before a very steep temperature gradient between the inner surface and the outer surface of the outer wall.

It will be appreciated that, given these effects, fuel passing through the outer walls via the wall mixing tubes 54 should maintain the outer walls at a temperature significantly closer to that of the mixing tubes 41. That is, when mixing tubes are integrated within the plenum walls, the heat transfer rates and temperatures for each component become substantially similar, which will significantly reduce the thermal strains that developed in conventional designs. As illustrated, the tubes that are integrated into the walls may include fuel injection holes or fuel ports 44 so they operate in much the same way as the mixing tubes 41 that pass through the interior of the fuel plenum 43. In this way, the present invention alleviates the temperature differential that typically occurred, while, at the same time, not negatively impacting the available cross-sectional flow area through the nozzle 17, so as not to impact the mass flow therethrough. In fact, the present invention may be used to increase the cross-sectional flow area within the nozzle 17 (i.e., the cross-sectional area available for mixing fuel and air before the mixture is injected into the combustion zone 23. It will be appreciated that this is a significant consideration given the fact that the area of the head-end is held to as small of a diameter as possible, while, at the same time, needing to satisfy other significant performance criteria, such as: 1) a specified mass flow rate requirement; 2) the need for a large number of mixing tubes so to ensure a highly blended air-fuel mixture that encourages even combustion and reduced emission levels; and 3) limiting the size of the pressure drop across the nozzle due to the parasitic losses they incur. It is therefore desirable to use all of the available cross-sectional nozzle area for mixing tube placement, and the present invention enables this through the integration of mixing tubes within plenum walls. An alternative embodiment includes passing only air through wall tubes. This may alleviate a portion of the thermal strains that develop in certain conventional designs, however, it sacrifices potential flow area within which fuel and air could be mixed. Such embodiments further would produce a less homogeneous fuel/air mixture for combustion, which, as will be appreciated, leads to uneven combustion and thereby negatively impacts emissions, such as increasing NOx and CO levels.

Referring to FIG. 5, a plurality of wall mixing tubes 54 may be formed within the shroud wall 45. Similar to the mixing tubes 41 formed through the interior of the fuel plenum 43, the wall mixing tubes 54 may extend between an inlet formed through the forward tubesheet 51 and an outlet formed through the aft tubesheet 52. Each of the plurality of wall mixing tubes 54 may include axially spaced fuel ports 44 that fluidly communicate with the interior of the fuel plenum 43. As illustrated, the fuel ports 44 of the wall mixing tubes 54 may include a small opening formed through the inner surface of the shroud wall 45. The inlets of the wall mixing tubes 54 formed through the forward tubesheet 51 may be configured for receiving the supply of compressed air from the interior of the cap assembly 21, and the outlets of the wall mixing tubes 54 formed through the aft tubesheet 52 may be configured for injecting a fuel-air mix into the combustion zone 23.

Figure 6:
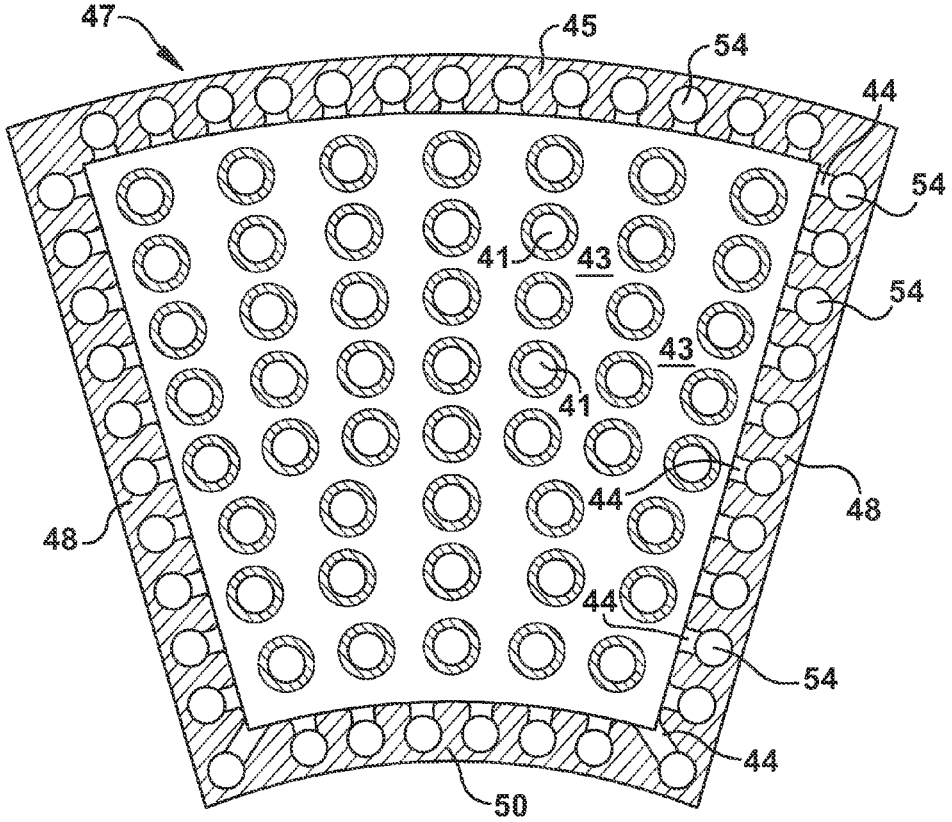
FIG. 6 is a front sectional view of a nozzle in accordance with exemplary embodiments of the present invention.

FIG. 6 is a front cross-sectional view of a nozzle section 47 of nozzle 17 in accordance with exemplary embodiments of the present invention. As indicated in FIG. 4, the nozzle 17 may be divided radially into sections. These nozzle sections 47 may be defined by sidewalls 48 that extends between the forward tubesheet 51 and the aft tubesheet 52, as well as between the outer radial boundary defined by the shroud wall 45 and an inner radial boundary 50. As illustrated, several of the mixing tubes 41 may be positioned within each nozzle section 47. In accordance with embodiments of the present invention, a plurality of wall mixing tubes 54 may be formed in the sidewalls 48 dividing the nozzle 17 into the nozzle sections 47. The wall mixing tubes 54 formed within the sidewalls 48 may be substantially similar to those described above in relation to the shroud wall 45, and may include axially spaced fuel ports 44 that communicate with the interior of the fuel plenum 43. According to alternative embodiments, the wall mixing tubes 54 may be formed on the shroud wall 45, the sidewalls 48, or both the shroud walls 45 and the sidewalls 48.

Figure 7:
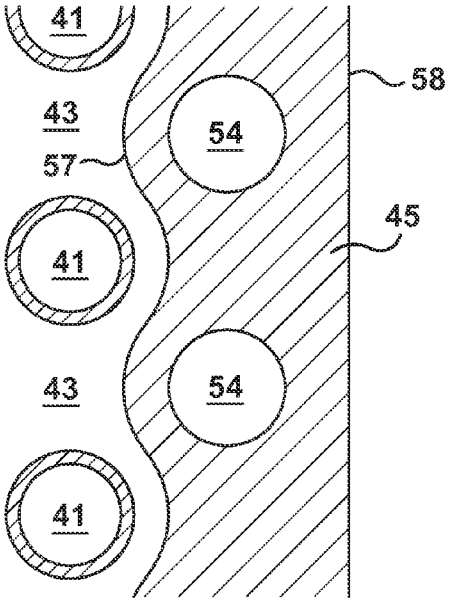
FIG. 7 is an enlarged front sectional view of a nozzle wall in accordance with embodiments of the present invention.
Figure 8:
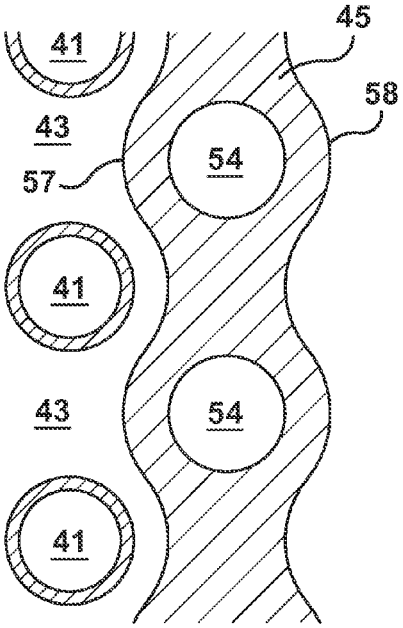
FIG. 8 is an enlarged front sectional view of a nozzle wall in accordance with alternative embodiments of the present invention.

FIGS. 7 and 8 provide enlarged front sectional views of nozzle sidewalls 48 in accordance with alternative embodiments of the present invention. As shown in FIG. 7, an interior surface 57 of the sidewalls 48 may be configured with an undulating contour. As used herein, the interior surface 57 of the sidewall is the surface that faces the interior of the fuel plenum 43 and thus is in contact with the fuel flowing therethrough. According to the embodiment of FIG. 7, the exterior surface 58 of the sidewall may be planar. As illustrated, the undulating contour of the interior surface 57 may be one that alternates between thick and thin sections. It may include a smoothly curved transition between the thick and thin sections. According to embodiments of the present invention, the wall mixing tubes 54 may be positioned so to correspond with the thick sections. That is, the wall mixing tubes 54 may be positioned within the thicker sections of the undulating contour. It will be appreciated that a benefit of this configuration is to increases the surface area of the interior surface 57 so to increase the heat transfer between the sidewall 48 and the fuel flowing through the fuel plenum 43. This should result in cooling the sidewalls 48 so to further reduce the temperature differential between the sidewall 48 and the mixing tubes 41. It will be appreciated that the configuration also maximizes flow area without sacrificing structural integrity. The undulating contour may be used with the wall mixing tubes 54 so that a constant wall thickness is maintained. As an additional aspect, the row of mixing tubes formed nearest the inner surface of the sidewall 48 may be positioned so to correspond with the thin sections of the profile. It will be appreciated that this configuration provides efficient use of cross-sectional flow area through the nozzle 17.

As illustrated in FIG. 8, according to another exemplary embodiment, both the inner and outer surface of the sidewall 48 may include the undulating contour. This configuration may be used to enhance the benefits described above. Additionally, the configuration of FIG. 8 may provide means for interlocking adjacent nozzle sections of the fuel nozzle 17. It will be appreciated that either of the configurations provided in FIGS. 7 and 8 may also be used on the shroud wall 45.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A micro-mixer nozzle for use in a combustor of a combustion turbine engine, the micro-mixer nozzle comprising:

a fuel plenum defined by a shroud wall connecting a periphery of a forward tube sheet to a periphery of an aft tubesheet;

wherein the shroud wall further comprises surface boundaries circumferentially surrounding the fuel plenum and a plurality of mixing tubes;

wherein the fuel plenum extends from the aft tubesheet to the forward tubesheet;

the plurality of mixing tubes extending across the fuel plenum for mixing a supply of compressed air and fuel, each of the mixing tubes forming a passageway between an inlet formed through the forward tubesheet and an outlet formed through the aft tubesheet;

a plurality of wall mixing tubes formed and incorporated in the shroud wall, such that the plurality of wall mixing tubes are formed and defined by the surface boundaries of the shroud wall; and wherein each of the plurality of wall mixing tubes comprises axially spaced fuel ports that fluidly communicate with the interior of the fuel plenum.

2. The micro-mixer nozzle according to claim 1, wherein each wall mixing tube of the plurality of wall mixing tubes extends between an inlet formed through the forward tubesheet and an outlet formed through the aft tubesheet.

3. The micro-mixer nozzle according to claim 2, wherein each of the plurality of mixing tubes comprises axially spaced fuel ports that fluidly communicate with the interior of the fuel plenum.

4. The micro-mixer nozzle according to claim 3, wherein the shroud wall comprises inner and outer surface; and wherein the fuel ports of the plurality of wall mixing tubes comprise an inlet formed through the inner surface of the shroud wall, and wherein the shroud wall is solid along the outer surface.

5. The micro-mixer nozzle according to claim 2, wherein inlets of the plurality of wall mixing tubes and the plurality of mixing tubes on the forward tubesheet are configured for receiving the supply of compressed air from a chamber positioned just forward of the forward tube sheet; and wherein the outlets of the plurality of wall mixing tubes and the plurality of mixing tubes on the aft tubesheet are configured for injecting a mixed flow of compressed air and fuel into a combustion zone.

6. A combustor in a combustion turbine engine, the combustor comprising a nozzle for mixing a supply of compressed air with a supply of fuel, wherein the nozzle further comprises:

a fuel plenum axially stacked between an upstream first chamber and a downstream second chamber, wherein the fuel plenum is defined between by a circumferentially extending shroud wall that extends axially between a forward tubesheet, which is directly adjacent to the upstream first chamber, and an aft tube sheet, which is directly adjacent to the downstream second chamber, and wherein the fuel plenum is radially divided into nozzle sections defined by sidewalls that extends between the forward tubesheet and the aft tubesheet;

wherein the shroud wall further comprises surface boundaries circumferentially surrounding the fuel plenum and a plurality of mixing tubes;

the plurality of mixing tubes positioned within each of the nozzle sections of the fuel plenum so to define a passageway connecting an inlet formed through the forward tubesheet to an outlet formed through the aft tubesheet; and a plurality of wall mixing tubes formed and incorporated in the sidewalls of each of the nozzle sections of the fuel plenum, such that the plurality of wall mixing tubes are formed and defined by surface boundaries of the sidewalls;

wherein each mixing tube of the plurality of mixing tubes and the plurality of wall mixing tubes include fuel ports fluidly communicating with an interior of the fuel plenum.

7. The combustor according to claim 6, wherein the shroud wall further comprises the plurality of wall mixing tubes.

8. The combustor according to claim 7, wherein the forward tubesheet and the aft tubesheet are parallel, and wherein each comprises a planar configuration.

9. The combustor according to claim 6, wherein the first chamber comprises a connection with a flow annulus defined between an inner radial wall and an outer radial wall;

wherein the first chamber includes a fuel line extending between an end cover and the fuel plenum; and wherein the second chamber comprises a combustion zone.

10. The combustor according to claim 6, wherein the fuel plenum comprises a cylindrical shape, and wherein the nozzle sections comprise wedge-shaped cross-sectional profiles.

11. The combustor according to claim 6, wherein an interior surface of the sidewalls of the nozzle sections comprises an undulating contour.

12. The combustor according to claim 11, wherein the undulating contour of the interior surface of the sidewalls includes alternating thick and thin sections; and wherein the plurality of wall mixing tubes are positioned so to correspond with the thick sections.

13. The combustor according to claim 11, wherein the fuel plenum comprises a first row of mixing tubes extending near and in spaced relation to the interior surface of the sidewalls; and wherein the first row of mixing tubes are positioned so to correspond with the thin sections of the undulating contour.

14. The combustor according to claim 11, wherein the fuel plenum comprises a first row of mixing tubes extending near and in spaced relation to the interior surface of the sidewalls;

wherein the undulating contour of the interior surface of the sidewalls includes alternating thick and thin sections;

wherein the plurality of wall mixing tubes are positioned so to correspond with the thick sections; and wherein the first row of mixing tubes are positioned so to correspond with the thin sections.

15. The combustor according to claim 12, wherein an exterior surface of the sidewalls of the nozzle sections comprise an undulating contour.

16. The combustor according to claim 13, wherein the undulating contour of the exterior surface of the sidewalls includes alternating thick and thin sections; and wherein the alternating thick and thin sections of the exterior surface correspond to the alternating thick and thin sections of the interior surface.

17. A combustion turbine engine having a compressor and a turbine operably connected by a combustor, wherein the combustor comprises:

a flowpath that includes: an upstream portion having ports fluidly communicating with a combustor discharge cavity into which compressed air from the compressor is supplied; and a downstream portion that directs a flow of combustion products into the turbine;

an inner radial wall and an outer radial wall that define a flow annulus;

an axially stacked first, second, and third chambers defined within the inner radial wall, wherein:

the first chamber extends between an endcover and the second chamber, wherein the endcover defines a forward axial boundary of the flowpath, and wherein the first chamber fluidly connects to the flow annulus via ports formed through the inner radial wall;

the second chamber extends between a forward tubesheet configured to separate the first and second chambers and an aft tubesheet configured to separate the second and third chambers;

the second chamber includes a circumferential extending shroud wall that encloses a fuel plenum from the forward tubesheet to the aft tubesheet;

wherein the shroud wall further comprises surface boundaries circumferentially surrounding the fuel plenum and a plurality of mixing tubes;

the plurality of mixing tubes extending across the fuel plenum, each configured to connect an inlet formed through the forward tubesheet to an outlet formed through the aft tubesheet, the mixing tubes each having axially spaced fuel ports that fluidly communicate with an interior of the fuel plenum; and the shroud wall includes a plurality of wall mixing tubes formed and incorporated in the shroud wall, such that the plurality of wall mixing tubes are formed and defined by the surface boundaries of the sidewalls, wherein the plurality of wall mixing tube extend between an inlet formed through the forward tubesheet to an outlet formed through the aft tubesheet, wherein each wall mixing tube of the plurality of wall mixing tubes having axially spaced fuel ports that fluidly communicate with the interior of the fuel plenum.

18. The combustion turbine engine according to claim 17, wherein the fuel plenum is divided into nozzle sections defined by sidewalls that extends between the forward tubesheet and the aft tubesheet; and wherein each of the sidewalls comprise the plurality of wall mixing tubes formed therein.

19. The combustion turbine engine according to claim 18, wherein the first chamber includes a fuel line extending between an endcover and a connection made with the fuel plenum of the second chamber;

wherein the third chamber comprises a combustion zone;

wherein the fuel plenum comprises a circular cross-sectional profile and the nozzle sections comprise wedge-shaped profiles defined within the circular cross-sectional profile.

* * * * *